United States Patent [19]

Santos

[11] Patent Number: 4,828,522

[45] Date of Patent: May 9, 1989

[54] AQUATIC EXERCISER

[76] Inventor: T. R. Santos, P.O. Box 6636, Chico, Calif. 95927

[21] Appl. No.: 208,966

[22] Filed: Jun. 20, 1988

[51] Int. Cl.[4] ..... B63C 9/08

[52] U.S. Cl. ..... 441/129; 441/132; 272/1 B

[58] Field of Search ..... 441/129, 130, 132, 136, 441/66, 40; 114/345, 352, 354; 440/21, 26, 27, 28, 29, 30, 31; 272/1 B, 71

[56] References Cited

U.S. PATENT DOCUMENTS

| | | | |
|---|---|---|---|
| 1,555,589 | 9/1925 | Farina | 441/132 |
| 1,625,579 | 4/1927 | Walters | 441/132 |
| 2,317,905 | 4/1943 | Galkin | 440/26 |

*Primary Examiner*—Joseph F. Peters, Jr.
*Assistant Examiner*—Edwin L. Swinehart

[57] ABSTRACT

The invention provides a bicycle-like pedal exerciser in a flotation structure designed for use in water. Two crescent shaped inflatable tubes are oppositely affixed in a fold-in frame horizontally disposed point to point. Hinged frame sections exposed between the flotation points and the convex inner wall tube shapes provides an operational and fixture-attach opening. A curved, flat bottom seat suspended downwardly in the opening faces a yoke-attached adjustable shaft downwardly affixed with a small flywheel turnable by bicycle-type pedals. The seat is adjustable and removable. An adjustable brake supplies a desired tension to the small flywheel. The device is operational in swimming pools or other limited water areas. The user sits or stands submerged to arm pit level and exercises by cranking the flywheel with the bicycle-like pedals. A variety of positions may be assumed for in-water therapy or for healthful exercising.

7 Claims, 3 Drawing Sheets

AQUATIC EXERCISER

BACKGROUND OF THE INVENTION

1. Field of the Invention

This invention relates to manual exercise equipment in general, and more specifically to a bicycle type exerciser adapted for use in water.

2. Description of the Prior Art

The extent of manual aquatic equipment is largely limited to entertainment devices primarily used for fun and enjoyment. Very few are specifically structured for systematic physical conditioning of the body or for use as physical therapy equipment. A search was conducted to produce floatable, aquatic exercise equipment, and the patents found which I considered most pertinent to my invention include the following:

1. U.S. Pat. No. 1,332,634, dated Mar. 2, 1920, was issued to Piateski for a propelled water bicycle.

2. Galkin was granted U.S. Pat. No. 2,317,905, on Apr. 27, 1943, for a manueverable water cycle.

3. On June 28, 1965, Wright was issued U.S. Pat. No. 3,285,220 for a manually propelled water vehicle shaped in the form of a horse.

4. Piccitto was granted U.S. Pat. No. 3,704,682, on Dec. 5, 1972, for "Pedal Operated Water Sport Vehicle".

5. On Mar. 18, 1986, Gulko was issued U.S. Pat. No. 4,576,580, for a pedal-powered watercraft.

6. U.S. Pat. No. 4,580,988, was granted to Correll on Apr. 8, 1986, for a floatation device adapted for physical therapy and recreation.

Only the Correll patent specifically states being applicable for use as a physical therapy device. The actual function of this device however, is as a floatation unit only and provides no moving mechanical apparatus for the benefit of exercise or physical therapy.

All other past art patents are found to be directed towards manually propelled aquatic vehicles provided as sport or entertainment devices. The devices shown are equipped with a paddle or propeller which provides propulsion for the apparatus, and all possess some form of steering means. None of the aquatic vehicles contain a braking system for their pedal propulsion units or a means for regulating the tension exerted by the user against the pedals. Many of the devices seen are not adjustable to accommodate different sized users. The Piateski, the Galkin, and the Wright patents show unadjustable devices. Some devices seen were not deflateable or collapsible for easy transportation. The Wright and Piateski patents show examples of the latter. None of the past art devices make the claim of being functional in a standing position with the seat removed. Several patents, namely Piateski, Wright, Piccitto, Gulko, and Correll, do not have adjustable or positionable pedals for use in a semi-reclining position.

The past art patents examined do not seem to present any devices adequately designed as aquatic exercising equipment. My invention avoids water propulsion mechanics and is specifically designed as exercise equipment principally to be used in swimming pools and small bodies of water where space is limited. In my invention, a seat suspended below a framed opening between two crescent shaped inflated tubes supports the user of my device. A vertical shaft fitted at the lower end with bicycle-like pedals and a small flywheel positioned in front of the user is provided as an exercising means. Since my device is not propelled, there is no need for a steering or guidance system. For exercising, a braking system is designed to operate with the small flywheel of my device. The braking system provides variable resistance to the pedals which can be regulated by the user. Increasing the brake tension increases the energy exerted by the user to rotate the pedals providing an added means of toning and conditioning the leg muscles. Unlike devices shown by Wright, Piccitto, and Gulko where the user is submerged only below the waist, the user operating my device is seated in the water up to the shoulder area. In my equipment, the user being almost completely submerged has an increase in buoyancy which enables working alternate muscle groups not likely effectively exercised in non-aquatic workouts. Also, this mostly submerged workout provides a means for a less strenuous exercise for those not physically capable of the more vigorous forms of exercise and for patients needing physical therapy. My device is also adjustable for the height of the user, and can even be used in a standing or semi-reclining position. Half handles on the outermost surfaces of both crescent shaped tubes provides in water controlling of my exerciser by a physical therapist during use by a patient receiving physical therapy. The two half handles come together to form a single carrying handle for transporting the exerciser when folded up.

I therefore feel my invention provides new, useful, and unique mechanics in aquatic exercise equipment neither presented in past art patented devices nor anticipated in the specifications and illustrations of the past-art patents.

SUMMARY OF THE INVENTION

In practicing my invention, I have provided a bicycle type exerciser attached to a floatation device. This floatation device is comprised of two crescent shaped inflatable tubes oppositely positioned point to point in horizontal alignment with one of the tubes enlarged centrally to form a back tube with a headrest. The second crescent shaped tube is a uniformly formed front tube. A fold-up framing structure supports the two crescent shaped inflatable tubes separated with a framed opening between them. The opening is the use area and the position for attachment of operational fixtures. The framing structure is a supporting rail-like member endwardly attached inside the tubes and shaped in paralleling alignment with the extreme curved ends of the crescent shaped inflatable tubes. A cross support frame member extends along the inside paralleling the convex curve of the back tube. The rail-like framing member has straight exposed sections a short distance on both sides between the oppositely positioned points of the crescent shaped tubes with both exposed sections of similar length and in parallel alignment. The exposed framing member sections and the opposing convex tube shapes form the framed operational opening of the device. The exposed framing sections are both cut and hinged centrally dividing the framing structure into folding halves. A manual transporting handle is formed by handle halves affixed on the outermost curved surface of both crescent tubes conjoining when the tubes are deflated and the framing structure is folded up. When the device is used for physical therapy, the half handles are useful for moving and controlling the exerciser in the pool by the physical therapist.

A seat formed with a rounded back and a flat seat bottom sufficiently large to accommodate variously sized human users is suspended below the tube and frame structure in the opened framed area. Adjustable support framing is affixed to the rounded seat back. The seat support framing has attachment and removal mechanics for attaching the seat adjustably to the foldable framing structure supporting the crescent shaped tubes. The seat is in a downward position adjacent the inside or convex curve of the back tube with the seat opening facing the convex curve of the front tube. For a user to maintaining position, two handle grips are provided, one on each side protruding sideways and frontwardly under the seat bottom. The seat is adjustable upwardly and downwardly and the frame mechanics allows hinged repositioning or complete removal of the seat.

A small flywheel turned by bicycle-like pedals is provided in a vertically inclined adjustable pedal shaft. The pedal shaft is structured of two telescoping tubular sections with a lower section encompassing an upper section. There are adjustment apertures in both sections and a releasable retainer pin locking the sections in a fixed position. The upper section is upwardly formed into a U-shaped yoke with the upwardly terminal U ends hingedly and removably attached to the exposed framing sections in a position immediately forward of the seat opening. The lower section is affixed inside downwardly with a small flywheel turnable by bicycle-like pedals. The pedals are affixed outside the lower section and attached by crank arms to the small flywheel. Resistance to the flywheel can be applied or released by adjusting a short threaded brake rod screw-fitted through a threaded aperture in a curved brake support bracket covering an exposed side of the flywheel. Resistance is applied by turning an adjustment knob and a brake pad affixed on the short threaded brake rod contacts the flywheel. A second brake control is also supplied in some embodiments of the invention. A turnable rod is attached at the front paralleling the adjustable pedal shaft which places an adjustable brake knob conveniently in reach of the user. Worm gear attachments at the lower end of the rod operate the resistance braking. The pedal shaft is adjustable upwardly and downwardly and hingedly mobile for repositioning from vertical to a variety of inclined angles.

The two crescent shaped tubes can be inflated and deflated through a pressure activated shut off valve in a valve stem, one in each crescent shaped inflatable tube. During use the hinges are locked on both of the exposed frame sections. For locking the exerciser horizontally disposed, substantially rectangular arm plates are movably pin-hinged adjacent the rear tube at one end into the exposed frame sections and affixed over the cut and hinged portion of the exposed frame sections. The free end of the arm plates are held by clip-type arm plate stops adjacent the front tube on the exposed frame sections. The arm plates are releasable from the clip arm plate stops and mobile at the pin-hinge for repositioning crosswise in the frame structure. The cross positioning of the arm plates releases the hinged portion allowing the frame structure to be folded up for transportation or storage purposes. For relieving restrictive water pressure against submerged exerciser structure, a multiple of water passage apertures are cut through the adjustable pedal shaft, the seat adjustable framing, and the flat seat bottom.

Therefore, a primary object of my invention is to provide a buoyant exercise and physical therapy apparatus adapted for use in water.

Another object of my invention is to provide an aquatic exerciser which simulates the action of a bicycle.

A further object of my invention is to provide an aquatic exerciser which is adjustable for various heights and sizes of users.

An even further object of my invention is to provide an aquatic exerciser which is deflateable and collapsible for easy transportation and storage.

A still further object of my invention is to provide an aquatic exerciser which can be adjusted to regulate the amount of exertion required by the user to rotate the pedals.

An even further object of my invention is to provide an aquatic exerciser which is capable of providing a non-strenuous workout, by being suspended in water, for physically debilitated users.

A still further object of my invention is to provide an exercise apparatus which is fun to use being operated in the cool pleasant environment of water.

Other objects and advantages will be readily understood by reading the following specification and subsequent comparison of numbered parts described with numbered parts illustrated in the accompanying drawings.

DRAWING REFERENCE NUMBERS

Figure 1:
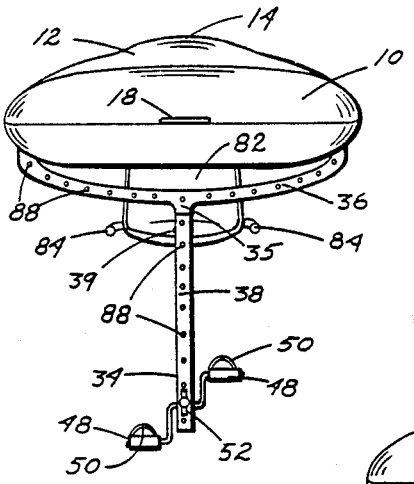
FIG. 1 is a frontal view of the preferred embodiment.

10 front inflatable tube
12 rear inflatable tube
13 nadir
14 head rest
16 air valve
18 carrying handles
20 internal support frame
22 hinged side panels
24 hinge
26 arm plates 28 arm plate stop
30 recessed attachment section
32 attachment apertures
34 lower tubular shaft section
35 upper tubular shaft section
36 U-shaped attachment yoke
37 adjustment apertures
38 adjustable pedal shaft
39 release pin
40 pivotal support bracket
42 bracket pin
44 threaded stud
46 attachment nut
48 pedals
50 pedal straps
52 threaded brake
54 crank arms
56 small flywheel
58 brake access
60 brake pad
61 alignment pin
62 short threaded brake rod
64 brake support bracket
66 knob
68 remote worm gear brake
70 extended brake rod
72 brake shaft worm gear
74 control shaft worm gear
76 control shaft
78 support braces
80 adjustable seat support frame
81 seat support frame bracket
82 seat
83 flat seat bottom
84 hand grips
86 horizontal seat brackets
88 flow apertures
90 water
92 user

DESCRIPTION OF THE PREFERRED EMBODIMENT

Figure 2:
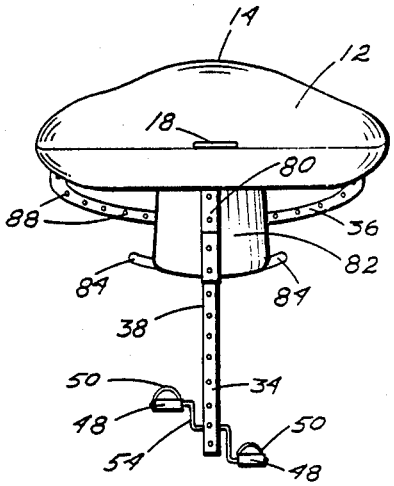
FIG. 2 is a rear view of FIG. 1.
Figure 3:
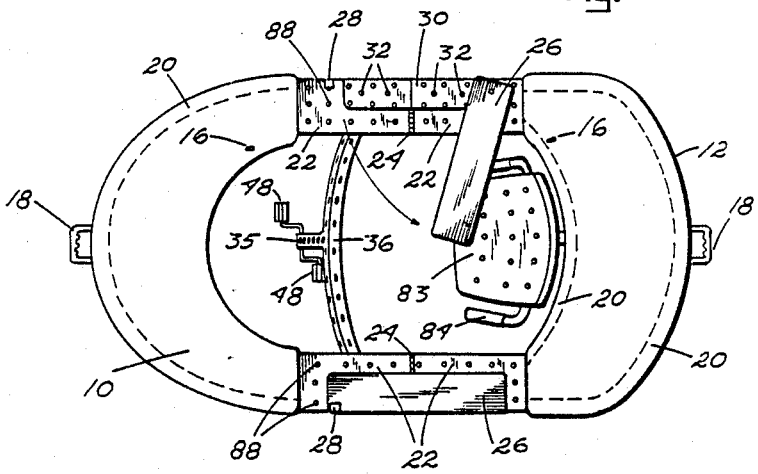
FIG. 3 is a top plan view of the aquatic exerciser, showing one arm plate locking the hinging system and the other arm plate retracted to release the frame for folding.

Referring now to the drawings at FIG. 1, FIG. 2, and FIG. 3 where the preferred embodiment of the invention, comprising an inflatable floatation exerciser with fold-up framing structure, is illustrated. Two crescent shaped inflatable tubes are oppositely positioned point to point in horizontal alignment. One of the tubes which is configured somewhat more round and inflates uniformly in shape is designated front inflatable tube 10. The other tube, structured to enlarge centrally when inflated and form a headrest 14, is designated rear inflatable tube 12. Front inflatable tube 10 and rear inflatable tube 12 are both inflatable and deflatable through an air pressure control valve, air valve 16, one valve in each tube. The fold-up framing structure includes internal support frame 20, hinged side panels 22 with recessed attachment section 30 being a part of hinged side panels 22. Hinge 24 movably attaches the two members of hinged side panels 22 together. Internal support frame 20 is a supporting rail-like member endwardly attached inside front inflatable tube 10 and inside rear inflatable tube 12 in curved paralleling alignment with the extreme curved ends of the crescent shaped inflatable tubes 10 and 12. Internal support frame 20 parallels the convex interfaced side of rear inflatable tube 12 as inside cross bracing for the fold up framing support. Hinged side panels 22 are formed by straight exposed sections of the rail-like framing structure extending a short distance on both sides between the oppositely positioned points of crescent shaped tubes 10 and 12, best seen in FIG. 3. Both exposed sections are of similar length and in parallel alignment. Hinged side panels 22 are the exposed framing sections both cut and hinged centrally by hinge 24 dividing the framing structure into folding halves. Recessed attachment section 30, is a shallow recession in each hinged side panels 22 which serves as the attachment area for other sections of the device. Arm plates 26 are substantially rectangular panels and are pin-hinged adjacent rear inflatable tube 12 to the surface of hinged side panels 22. Arm plates 26 fit over the cut and hinged portion of hinged side panels 22 and are releasably retained by clip-like arm plate stops 28. Arm plates 26 are moveable at the pin-hinge for repositioning crosswise in the frame structure to release hinge 24 and allow the frame structure to be folded up. Carrying handles 18 on the extreme outer curved surfaces of both crescent shaped tubes 10 and 12 are convenient fixtures for in-pool movement control by a physical therapist when the buoyant aquatic exerciser is used as a physical therapy device. Carrying handles 18 also form a single, manual transporting handle for carrying the folded aquatic exerciser.

Seat 82, sufficiently large to accommodate variously sized human users is suspended below internal support frame 20. Seat 82 has a formed rounded back and a flat seat bottom 83 and is affixed to adjustable seat support frame 80 by several horizontal seat brackets 86. Adjustable seat support frame 80 with pivotal support bracket 40 and threaded stud 44 at one end is removably affixed to U-shaped apertured seat support frame bracket 81 by attachment nut 46. Seat support frame bracket 81 is permanently attached to internal support frame 20 and extends downwardly through rear inflatable tube 12 as shown in an enlarged view in FIG. 9 where the nadir 13 of the curved bottom of rear inflatable tube 12 is illustrated extending below seat support frame bracket 81. Pivotal support bracket 40 has adjustment apertures 37 sized to accept release pin 39 to lock adjustable seat support frame 80 in several positions. Adjustable seat support frame 80 is comprised of two telescoping sections lockable by adjustment apertures 37 and release pin 39. The telescoping action provides upward and downward adjustment means for seat 82.

Figure 4:
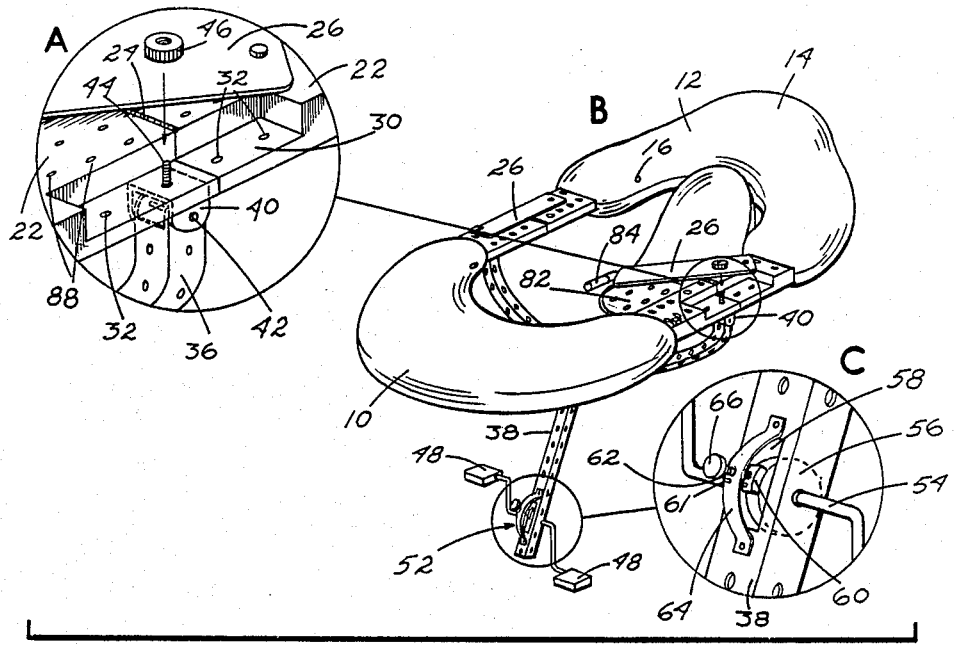
FIG. 4 is a perspective view of the preferred embodiment where A is an enlargement of the pedal support frame attachment means, B is the aquatic exerciser and C is an enlargement of the first embodiment of the adjustable manual braking system.
Figure 5:
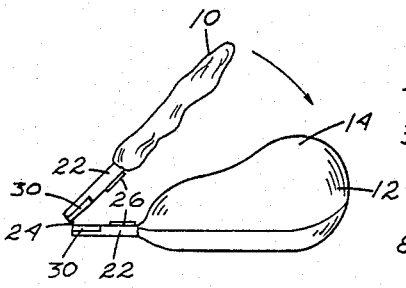
FIG. 5 is a side view of the floatation tubes in the process of being folded.
Figure 6:
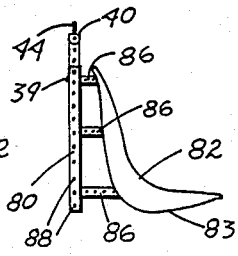
FIG. 6 is a side view of the detached seat and support structure.
Figure 7:
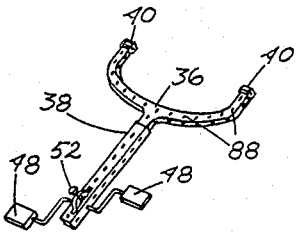
FIG. 7 is a perspective view of the pedal support frame.

An adjustable pedal shaft 38 is vertically oriented and structured of two telescoping tubular sections, a lower tubular shaft section 34 encompassing an upper tubular shaft section 35. Adjustment apertures 37, located in both sections, interact with release pin 39 for locking the sections in a fixed position, allowing adjustable pedal shaft 38 to be lengthened or shortened according to the user's needs. Upper tubular shaft section 35 is upwardly formed into U-shaped attachment yoke 36. The upwardly terminal U ends of U-shaped attachment yoke 36 are hingedly and removably fastened in recessed attachment section 30 through attachment apertures 32 by pivotal support bracket 40 and bracket pin 42, best seen in FIG. 4. Threaded stud 44 holds pivotal support bracket 40 attached to hinged side panels 22 in recessed attachment section 30 secured by attachment nut 46. The pivotal support bracket 40 which supports seat 82 is attached to internal support frame 20 in the same manner of attachment as the two ends of U-shaped attachment yoke 36. U-shaped attachment yoke 36 is attached immediately forward of the frontal opening of seat 82. Lower tubular shaft section 34 is affixed inside downwardly with a small flywheel 56 turnable by bicycle-like pedals 48 affixed outside lower tubular shaft section 34. The upper surface of pedals 48 are affixed with pedal straps 50 which serve to retain user's 92 feet in position. Pedals 48 are attached by crank arms 54 to small flywheel 56. Resistance to small flywheel 56 is provided in two different embodiments of brake systems, the first being threaded brake 52. Threaded brake 52, depicted in FIG. 4, can be engaged or released by adjusting short threaded brake rod 62 which is screw-fitted through a threaded aperture in curved brake support bracket 64 covering an exposed side of small flywheel 56. The exposed side of small flywheel 56 is accessible through a rectangular aperture in lower tubular shaft section 34 called brake access 58, also seen in FIG. 4. Resistance is applied by turning adjustment knob 66 which applies brake pad 60 onto small flywheel 56. Means are provided in alignment pin 61, to prevent brake pad 60 from rotating with knob 66. Alignment pin 61 is attached to the surface of brake pad 60 and movably extends through an aperture located in brake support bracket 64.

Figure 11:
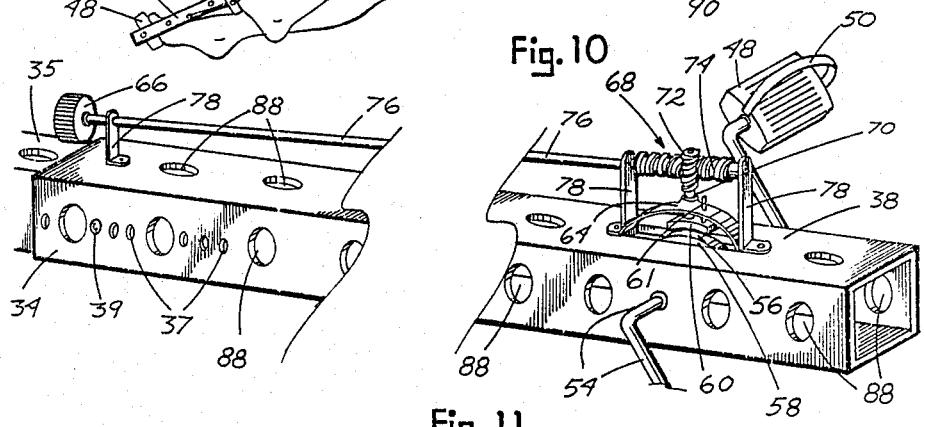
FIG. 11 is a perspective illustration of the second embodiment of the braking system using a manual remote worm gear actuated brake.

The second braking means is provided in remote worm gear brake 68. A turnable control shaft 76 is attached parallel to the front section of adjustable pedal shaft 38 by support braces 78. The upper end of control shaft 76 is affixed with a brake control knob 66, which is conveniently in reach of user 92. The opposite end of control shaft 76 is affixed with control shaft worm gear 74 which is also supported by support braces 78, best seen in FIG. 11. Brake shaft worm gear 72 abuts control shaft worm gear 74 at a right angle and is rotated as control shaft worm gear is rotated. The lower end of brake shaft worm gear 72, known as extended brake rod 70, extends downward through brake support bracket 64, and is affixed with brake pad 60. The rotation of brake shaft worm gear 72 moves brake pad 60 against or away from small flywheel 56 in accordance with adjustments made by turning knob 66. Alignment pin 61 is also present in the second brake embodiment of remote worm gear brake 68.

Figure 8:
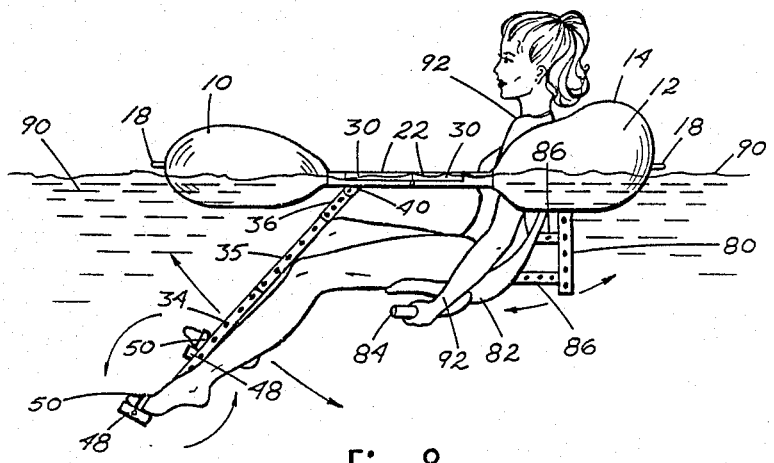
FIG. 8 is a side view of the devices in use with the user exercising in a sitting position.
Figure 9:
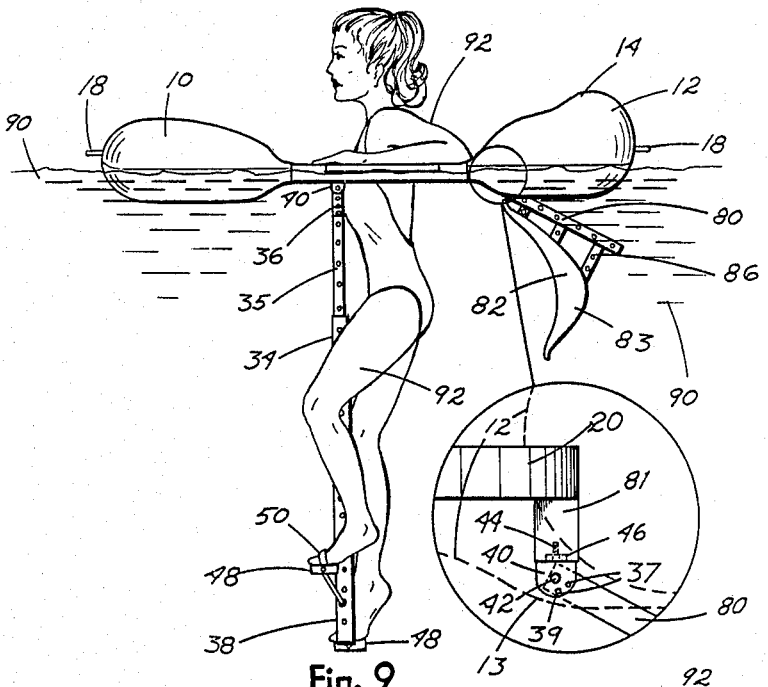
FIG. 9 is a side view illustrating use of the device with the seat folded back and the user in a standing position. Also shown is an enlarged view of the adjustable seat support frame attachment.
Figure 10:
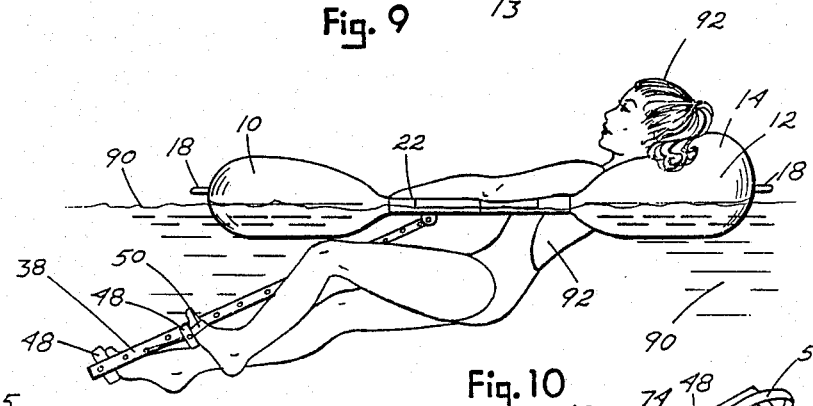
FIG. 10 is a side view of the device with the seat removed and the user operating the device in a semi-reclining position.

The assemblage of the sections provides adjustable pedal shaft 38 with adjustability both upwardly and downwardly and with hinged mobility for being repositioned from vertical to a variety of inclined angles as illustrated in FIG. 8, FIG. 9 and FIG. 10. User 92 as shown in FIG. 8 can exercise in a seated position. Hand grips 84 are attached to the sides of flat seat bottom 83 to assist user 92 in maintaining a secure position while exercising. User 92 may elect a stand-up position as shown in FIG. 9. Seat 82 can be swung back in an out-of-way position and adjustable pedal shaft 38 can be lengthened to suit. If user 92 elects to exercise in a reclining position as illustrated in FIG. 10, seat 82 can be easily completely removed and adjustable pedal shaft 38 can be angled forward for comfortable use in the reclined position. Restrictive water 90 pressure against the submerged exerciser structure is relieved by a multiple of water 90 flow apertures 88 cut through adjustable pedal shaft 38, U-shaped attachment yoke 36, hinged side panels 22, seat 82, adjustable seat support frame 80, and horizontal seat brackets 86.

Although I have described my invention in detail in the specification, it is to be understood that modifications in the structure and design of my device may be practiced which do not exceed the intended scope of the appended claims.

What I claim as my invention is:

1. A buoyant aquatic exerciser and physical therapy device for human use, comprising:

an inflatable floatation means with fold-up framing structure;

said inflatable flotation means being two crescent shaped inflatable tubes having outermost curved surfaces oppositely positioned point to point in horizontal alignment with one of said tubes being somewhat rounder and more uniformly inflated and designated a front inflatable tube and the other of said tubes structured to inflate with an enlarged headrest-like center being designated a rear inflatable tube;

said fold-up framing structure being a supporting rail-like member endwardly attached inside said tubes and shaped in alignment with the curved surfaces of said crescent shaped inflatable tubes, there being a cross bracing of said framing member inside and aligned with the curved surface of said rear inflatable tube, said rail-like framing member extending straight and having exposed sections a short distance on both sides between said oppositely positioned points of said crescent shaped tubes with both exposed sections of similar length and in parallel alignment, said exposed framing sections both cut and hinged centrally dividing said framing structure into folding halves, there being a carrying transporting handle formed by handle halves affixed on the outermost curved surfaces of both said crescent tubes conjoining with the deflation of said inflatable tubes and folding of said framing structure;

a seat;

said seat having a formed rounded back and a flat seat bottom sufficiently large to accommodate variously sized human users there being adjustable supporting structure affixed to said rounded seat back having attachment and removal mechanics for attaching said seat adjustably to said foldable framing structure in a downward position adjacent said curved surface of said rear inflatable tube with said seat, the opening thereof, facing said front inflatable tube, said seat being adjustable upwardly and downwardly and said mechanics allowing hinged repositioning and removal of said seat;

an adjustable pedal shaft;

said adjustable pedal shaft being structured of two telescoping tubular sections, a lower section encompassing an upper section, there being adjustment apertures in both said sections and a releasable retainer pin locking said sections in a fixed position, said upper section upwardly forming a U-shaped yoke with the upwardly terminal U ends hingedly and removably attached to said exposed framing sections in a position immediately forward of said seat opening, said lower section affixed inside with a small flywheel turnable by bicycle-like pedals affixed outside said lower section attached by crank arms to said small flywheel, the assemblage of said sections behind such that said pedal shaft is adjustable upwardly and downwardly and hingedly mobile for repositioning from vertical to a variety of inclined angles;

means for controlled inflating and deflating said crescent shaped tubes;

means for locking said hinges on said exposed frame sections to maintain said frame and said crescent shaped inflatable tubes horizontally disposed;

means for applying and releasing resistance to said small flywheel turnable by said bicycle-like pedals;

means to relieve restrictive water pressure against submerged exerciser structure.

2. The buoyant aquatic exerciser of claim 1 wherein said means for controlled inflating and deflating said crescent shaped tubes includes a pressure activated shut off valve in a valve stem, one in each said crescent shaped inflatable tube.

3. The buoyant aquatic exerciser of claim 1 wherein said means for locking said hinges on both said exposed frame sections are substantially rectangular arm plates pin-hinged adjacent said rear inflatable tube at one end into said exposed frame sections and affixed over said hinged portion of said exposed frame sections by clip type arm plate stops adjacent said front inflatable tube on said exposed frame sections with said arm plates being releasable from said clip arm plate stops and mobile at said pin-hinge for repositioning crosswise in said frame structure releasing said hinged portion for said fold-up of said frame structure.

4. The buoyant aquatic exerciser of claim 1 wherein said means for applying and releasing resistance to said small flywheel turnable by said bicycle-like pedals includes a short threaded brake rod adjustably screw-fitted through a threaded aperture in a curved brake support bracket covering an exposed side of said flywheel there being a brake pad affixed on said short threaded brake rod adjacent said flywheel available for contact with said flywheel and oppositely on said short threaded brake rod there being a manual turn adjustment knob.

5. The buoyant aquatic exerciser of claim 1 wherein said means for applying and releasing resistance to said small flywheel turnable by said bicycle-like pedals includes an extended brake rod turnably fastened longitudinally parallel to said lower section of said adjustable pedal shaft, said extended brake rod upwardly affixed with a manual turn adjustment knob and downwardly fitted with worm gearing structured to apply and release a brake pad to said small flywheel turnable by said bicycle-like pedals in accordance with turning of said manual turn adjustment knob.

6. The buoyant aquatic exerciser of claim 1 wherein said means for relieving restrictive water pressure against submerged exerciser structure includes a multiple of water passage apertures cut through said adjustable pedal shaft, said seat adjustable framing, and said flat seat bottom.

7. The buoyant aquatic exerciser of claim 1 wherein said handle halves may be used for in-pool movement control by a physical therapist when said buoyant aquatic exerciser is used as said physical therapy device.

* * * * *